US009221243B2

(12) United States Patent
Diews

(10) Patent No.: US 9,221,243 B2
(45) Date of Patent: Dec. 29, 2015

(54) DOCTOR-TYPE INK FOUNTAIN HAVING A REAR WALL IN A PRINTING PRESS AND PRINTING PRESS HAVING A DOCTOR-TYPE INK FOUNTAIN

(71) Applicant: HEIDELBERGER DRUCKMASCHINEN AG, Heidelberg (DE)

(72) Inventor: Michael Diews, Birkenau (DE)

(73) Assignee: HEIDELBERGER DRUCKMASCHINEN AG, Heildelberg (DE)

( * ) Notice: Subject to any disclaimer, the term of this patent is extended or adjusted under 35 U.S.C. 154(b) by 15 days.

(21) Appl. No.: 13/861,799

(22) Filed: Apr. 12, 2013

(65) Prior Publication Data

US 2013/0269556 A1 Oct. 17, 2013

(30) Foreign Application Priority Data

Apr. 16, 2012 (DE) ..... 10 2012 007 604

(51) Int. Cl.
*B41F 31/03* (2006.01)
*B41F 31/06* (2006.01)

(52) U.S. Cl.
CPC *B41F 31/06* (2013.01); *B41F 31/03* (2013.01)

(58) Field of Classification Search
CPC ..... B41F 31/03; B41F 31/02; B41F 31/06; B41F 31/00; B41F 31/07
USPC ..... 101/364, 350.1, DIG. 34
See application file for complete search history.

(56) References Cited

U.S. PATENT DOCUMENTS

| | | | | |
|---|---|---|---|---|
| 1,757,808 | A | 5/1930 | Marquardt | |
| 1,778,600 | A | 10/1930 | Jones | |
| 3,585,932 | A * | 6/1971 | Granger | 101/351.7 |
| 4,158,333 | A | 6/1979 | Navi | |
| 5,255,603 | A | 10/1993 | Sonneville et al. | |
| 5,662,043 | A | 9/1997 | Fischer et al. | |
| 6,312,367 | B1 * | 11/2001 | Rogge | 492/35 |
| 6,655,280 | B2 * | 12/2003 | Cartellieri et al. | 101/365 |
| 6,799,509 | B2 | 10/2004 | Naniwa | |
| 7,607,390 | B2 | 10/2009 | Donath et al. | |
| 2007/0169651 | A1 | 7/2007 | Michels et al. | |

FOREIGN PATENT DOCUMENTS

| | | | |
|---|---|---|---|
| DE | 10 2006 002 170 | A1 | 7/2007 |
| EP | 0 222 226 | A2 | 5/1987 |
| EP | 0 683 730 | A1 | 11/1995 |
| EP | 0 753 408 | B1 | 1/1997 |
| EP | 1 815 983 | A2 | 8/2007 |
| JP | 2003-154630 | A | 5/2003 |

OTHER PUBLICATIONS

German Patent and Trademark Office Search Report, dated May 15, 2012.

* cited by examiner

*Primary Examiner* — Jill Culler
*Assistant Examiner* — Leo T Hinze
(74) *Attorney, Agent, or Firm* — Laurence Greenberg; Werner Stemer; Ralph Locher

(57) ABSTRACT

A doctor-type ink fountain includes a rear wall and a row of flow profiles provided along the rear wall. The flow profiles are obliquely aligned at an acute angle relative to an axis of rotation of a screen roller interacting with the doctor-type ink fountain. A printing press having the doctor-type ink fountain is also provided.

10 Claims, 5 Drawing Sheets

DOCTOR-TYPE INK FOUNTAIN HAVING A REAR WALL IN A PRINTING PRESS AND PRINTING PRESS HAVING A DOCTOR-TYPE INK FOUNTAIN

CROSS-REFERENCE TO RELATED APPLICATION

This application claims the priority, under 35 U.S.C. §119, of German Patent Application DE 10 2012 007 604.5, filed Apr. 16, 2012; the prior application is herewith incorporated by reference in its entirety.

BACKGROUND OF THE INVENTION

Field of the Invention

The present invention relates to a doctor-type ink fountain for a printing press including a rear wall having at least one flow profile for fluidically influencing the printing ink.

Doctor-type ink fountains of that kind are used in anilox inking units. They interact with a screen roller. A problem may arise if the screen roller has a helical engraving. An undesired effect of an engraving with that shape is that ink is conveyed towards one of the ink fountain ends since the engraving acts like a worm conveyor. The result is an uneven distribution of ink in the ink fountain, which has a negative effect on the quality of the print.

German Patent Application DE 10 2006 002 170 A1, corresponding to U.S. Patent Application Publication No. 2007/0169651, discloses a doctor-type ink fountain in which a rear wall has a flow profile facing the screen roller. The flow profile forms an outer corner, which in cooperation with the circumferential surface of the screen roller, forms a bottleneck. When the printing ink is conveyed towards the bottleneck due to the rotation of the screen roller, the flow profile causes a dynamic pressure of the printing ink in the region of the bottleneck. Due to that dynamic pressure, the engraved depressions or screen depressions (cells or grooves) of the screen roller are filled largely without air inclusion and very evenly. However, the flow profile does not solve the problem explained above. If the screen depressions of the prior art screen roller were of helical shape and if they thus conveyed the ink in a predominant direction, the flow profile in the form of the outer corner would not have any influence thereon at all.

U.S. Pat. No. 4,158,333 describes a doctor-type ink fountain in which a row of vertical plates is provided to improve the flow of ink onto the circumferential surface of the screen roller. The plates are also intended to improve the circulation of ink and to avoid turbulences.

European Patent EP 0 683 730 B1, corresponding to U.S. Pat. No. 5,255,603, describes an ink container including a deflection device. The deflection device includes throttling bodies disposed in a matrix. The document points out that the ink flow caused by the screen roller is directed in a direction corresponding to the direction of rotation of the screen roller. The ink flow may be deflected by the walls of the ink container so that the ink flow is parallel to the axis of rotation of the screen roller.

U.S. Pat. No. 7,607,390 B2 describes a doctor-type ink fountain in which a stirrer moves back and forth in the ink supply to remove air bubbles.

The prior art does not address the problem explained in the introduction to any satisfactory extent.

SUMMARY OF THE INVENTION

It is accordingly an object of the invention to provide a doctor-type or blade-type ink fountain having a rear wall in a printing press and a printing press having a doctor-type or blade-type ink fountain, which overcome the hereinafore-mentioned disadvantages of the heretofore-known devices of this general type and in which an ink supply is more evenly distributed over a printing width.

With the foregoing and other objects in view there is provided, in accordance with the invention, a doctor-type ink fountain for a printing press, comprising a rear wall and a row of flow profiles provided along the rear wall for fluidically or flow-mechanically influencing printing ink, the flow profiles being obliquely disposed at an acute angle relative to an axis of rotation of a screen roller interacting with the doctor-type ink fountain.

The flow profiles even out the distribution of ink in the doctor-type ink fountain and avoid an undesired measurable increase of ink density from one machine side to the other in a printed image.

Due to their angled alignment, the flow profiles are capable of at least partially diverting or deflecting a flow of ink from one machine side to the other as it is created by a helical engraving of the screen roller. As a result, the ink flows along the respective flow profile in a direction that is different from the conveying direction of the ink as it is caused by the helical engraving. Due to the fact that the respective flow profile is neither perpendicular nor parallel but extends at an angle relative to the axis of rotation of the screen roller, the flow of ink created by the helical engraving itself drives the flow of ink along the respective flow profile. Within the doctor-type ink fountain, a form of ink circulation may be created wherein the helical engraving of the screen roller causes a flow in one direction and the flow profiles cause a flow in the opposite direction. The flow profiles may be profiled and directed in such a way that the conveying flow caused by the engraving is compensated by the backward flow or backward flows caused by the flow profiles.

In accordance with another feature of the invention, the flow profiles may be constructed as depressions, for example grooves, or as protrusions, for example ribs. The depth or height of the flow profiles may be a few millimeters, for example 1 millimeter to 5 millimeters. The flow profiles may be straight or curved. If they are curved, a connecting line of two end points of the respective flow profile is aligned at an angle relative to the axis of rotation of the screen roller. For example, each flow profile may have an arcuate shape, with the connecting line being a circle secant. The connecting line may likewise be any other arc secant, for example a parabola secant.

With the objects of the invention in view, there is concomitantly provided a printing press, comprising a doctor-type ink fountain according to the invention.

Other features which are considered as characteristic for the invention are set forth in the appended claims.

Although the invention is illustrated and described herein as embodied in a doctor-type ink fountain having a rear wall in a printing press and a printing press having a doctor-type ink fountain, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
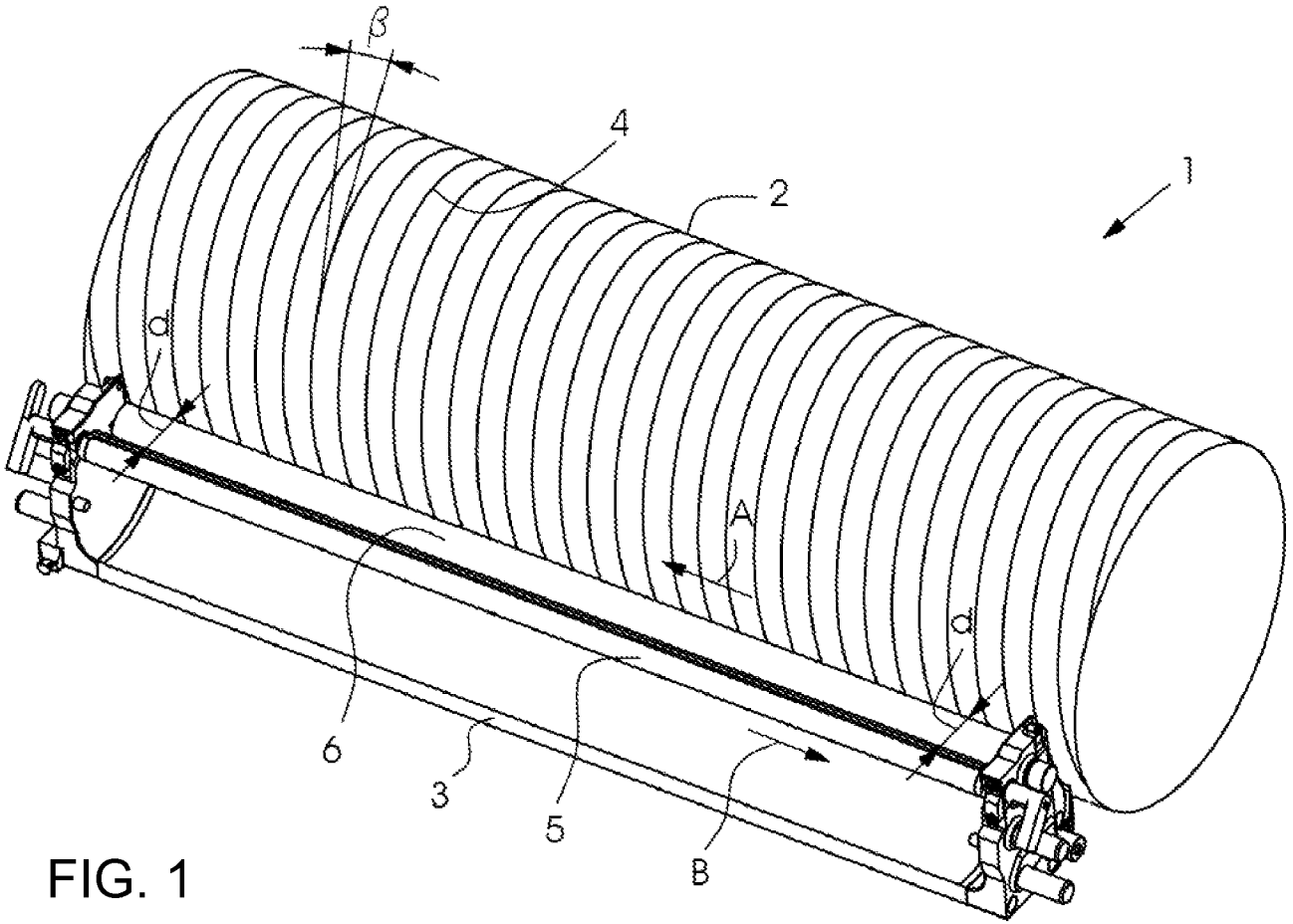
FIGS. 1 to 3 are diagrammatic, perspective views illustrating a doctor-type ink fountain including flow profiles according to the invention.

Referring now to the figures of the drawings in detail and first, particularly, to FIG. 1 thereof, there is seen a section of a printing press 1 for lithographic or planographic offset printing on sheet-shaped printing substrates. The illustrated section includes a screen roller 2 and a doctor-type ink fountain 3 of an anilox inking unit of the printing press 1. The screen roller 2 has an engraving 4 formed by a helical groove rising at an angle β (helix angle). The doctor-type ink fountain 3 has a rear wall 5 and a doctor blade 7 (seen in FIG. 2) between which an ink supply 6 is provided. During printing, the ink supply 6 forms a roll of ink having a rotation which is driven by friction with the rotating screen roller 2. The doctor blade 7 rests against the screen roller 2 to scrape excess ink off the screen roller 2. Due to its helical shape, the engraving 4 creates a conveying effect similar to that of a worm conveyor, which causes a part of the ink in the ink supply 6 to flow in a forward conveying direction A.

Figure 2:
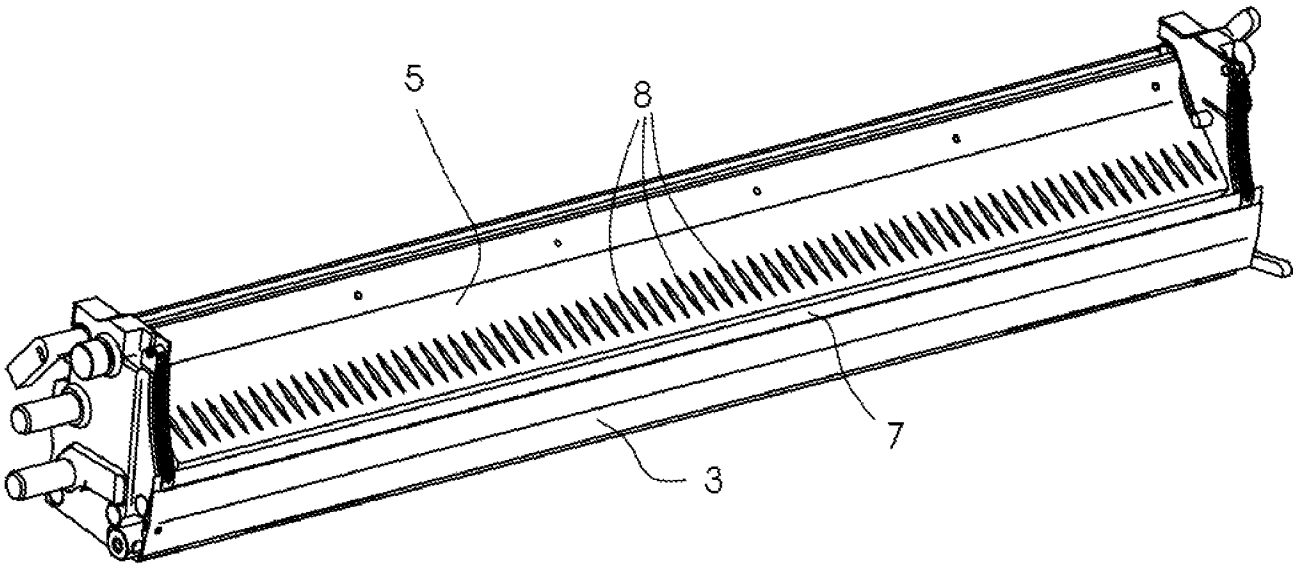

For reasons of improved visibility, FIG. 2 shows the doctor-type ink fountain 3 without the screen roller 2 and without the ink supply 6, from an opposite viewing direction compared to that of FIG. 1. The interior of the doctor-type ink fountain 3 is visible. The doctor-type ink fountain 3 has been removed from the printing press 1 by the operator, for example for maintenance purposes. The rear wall 5 is supported so as to be adjustable relative to the doctor blade 7 so that the level of the ink supply 6 may be raised or lowered. For this purpose, the rear wall 5 is supported in joints, that are not specified any further herein, in order to pivot relative to the doctor blade 7. A side of the rear wall 5 facing the screen roller 2 is provided with a row of flow profiles 8 that are equidistantly spaced-apart from each other. The row extends from one end of the rear wall 5 to the other end and is parallel to an axis of rotation 9 (seen in FIG. 3) of the screen roller 2.

The flow profiles 8 are grooves, each of which has a triangular cross-section defined by a straight groove wall and a curved groove wall perpendicular to the straight groove wall. The flow profiles 8 have been milled into the rear wall 5 using a milling spindle that is positioned at an angle relative to the rear wall 5 to create a sickle shape of the flow profiles 8. At the deepest spot, the groove depth of the flow profiles 8 is 2 to 3 millimeters.

Figure 3:
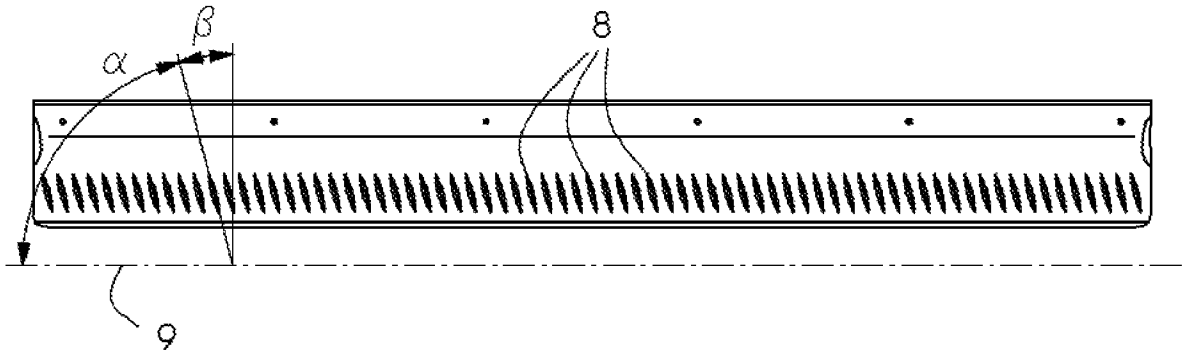

FIG. 3 illustrates the rear wall 5 as an individual piece. In terms of its longitudinal axis, which is defined by the straight groove wall, each flow profile 8 is aligned at an angle α relative to the axis of rotation 9 of the screen roller 2. The angle α is between 15° and 45°, preferably between 15° and 30°, for instance approximately 25°. The complementary angle of angle α is angle β, which is preferably of the same size as the helix angle β of the engraving 4 (seen in FIG. 1). In the assembled state (seen in FIG. 1), the angles β of the engraving 4 and of the flow profile 8 have opposite signs.

The flow profiles 8 work as follows: the rotation of the screen roller 2 in a counter-clockwise direction in FIG. 1 drives the clockwise rotation of the ink roll formed by the ink supply 6. On one side, this ink roll rests against the screen roller 2. On the other side, the ink roll rests against the rear wall 5. Due to the rotation of the ink roll, the ink roll travels from bottom to top along the rear wall 5. This sliding movement of the ink roll along the rear wall 5 causes the ink to meet the flow profiles 8, which deflect the ink into a backward conveying direction B. The ink that flows in from the bottom along the flow profiles 8 causes the deflected ink within the ink roll or ink supply 6 to be urged and conveyed in the backward conveying direction B. The opposing angles of slope of the engraving 4 (which rises towards the left in FIG. 1) and of the flow profiles 8 (which, although not visible, rise towards the right in FIG. 1) result in the backward conveying direction B that is antiparallel to the forward conveying direction A. As shown in FIG. 1, the thickness D of the ink supply 6 is identical on both ends due to the fact that the flow profiles 8 compensate the conveying effect of the engraving 4.

Figure 4:
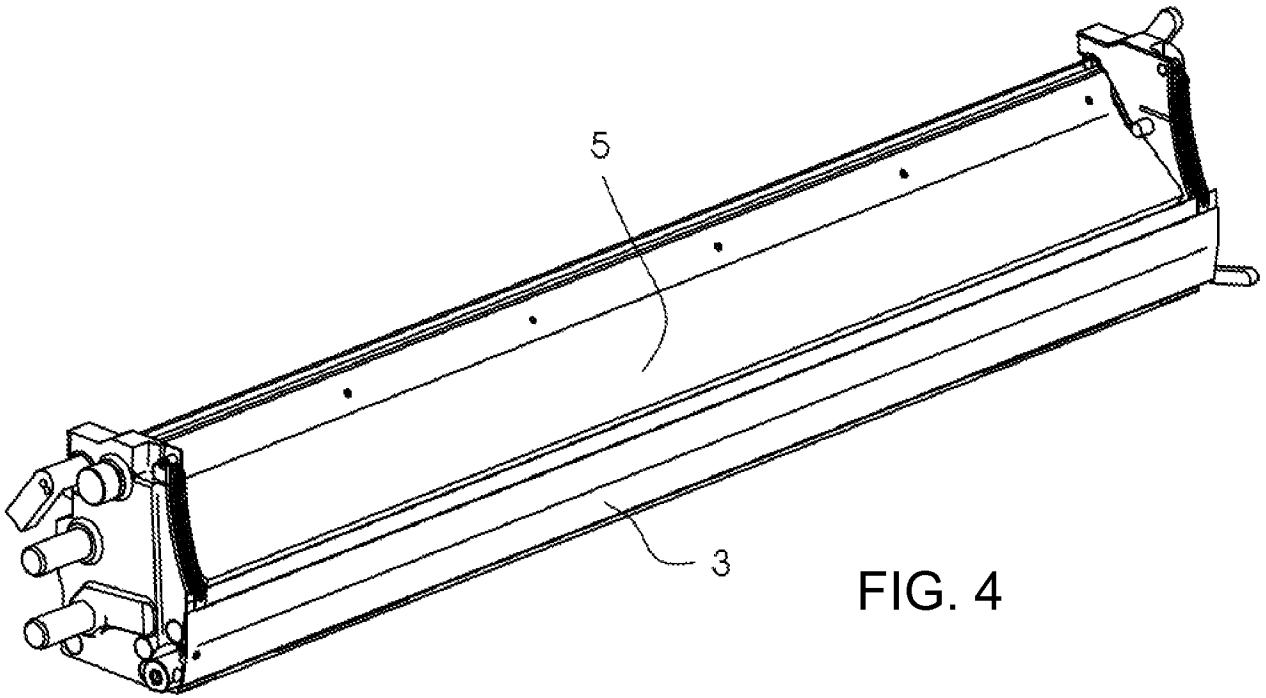
FIGS. 4 and 5 are perspective views illustrating a doctor-type ink fountain without the flow profiles according to the invention.
Figure 5:
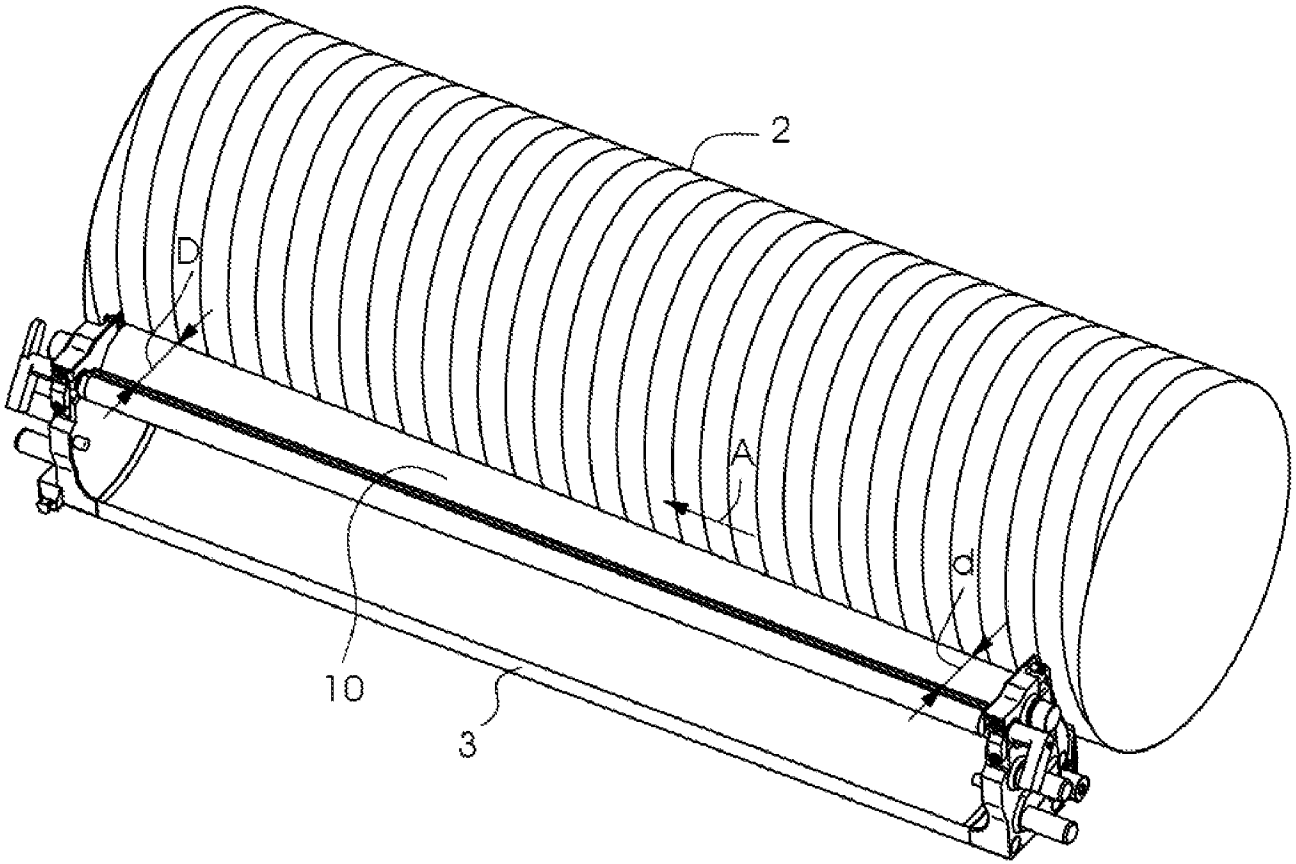

By comparison, FIGS. 4 and 5 illustrate an ink fountain 3 assumed to be without flow profiles 8. Without the flow profiles 8, there would be no backward flow of ink in the backward conveying direction B. As a result, the engraving 4 would urge the ink within the ink supply 10 towards one end of the ink supply 10 (towards the left end in FIG. 5). There a thickness D of the ink supply 10 would therefore be greater than a thickness d at the other end. A comparison between the ink supply 6 that is evenly distributed across its length as shown in FIG. 1 and the unevenly distributed ink supply 10 shown in FIG. 5 reveals the difference made by the flow profiles 8.

The invention claimed is:

1. In a printing press having a screen roller with an axis of rotation, a doctor-type ink fountain interacting with said screen roller having a helical engraving, the doctor-type ink fountain comprising:

a rear wall having a side;

said rear wall being formed with a row of flow profiles on said side, said flow profiles being configured to fluidically influence printing ink;

said flow profiles being obliquely aligned at an acute angle relative to the axis of rotation of the screen roller, said flow profiles being profiled and directed to compensate for a conveying flow caused by the helical engraving of the screen roller with a backward flow or backward flows caused by said flow profiles, said flow profiles rising in a direction opposite the direction of slope of the helical engraving in an operating condition of the doctor-type ink fountain; and a doctor blade, said rear wall together with said flow profiles being supported to be adjustable relative to said doctor blade.

2. The doctor-type ink fountain according to claim 1, wherein said flow profiles are depressions or protrusions.

3. The doctor-type ink fountain according to claim 1, wherein said flow profiles are depressions in the form of grooves.

4. The doctor-type ink fountain according to claim 1, wherein said flow profiles are sickle-shaped.

5. The doctor-type ink fountain according to claim 1, wherein each of said flow profiles has a maximum depth or height of 1 mm to 5 mm.

6. The doctor-type ink fountain according to claim 1, wherein said acute angle ranges from 15° to 45°.

7. The doctor-type ink fountain according to claim 1, wherein the screen roller has a helical engraving with a helical angle approximately equal to an angle complementary to said acute angle.

8. A printing press, comprising:

a doctor-type ink fountain according to claim 1.

9. The doctor-type ink fountain according to claim 1, wherein said flow profiles are depressions formed in said rear wall or protrusions.

10. The doctor-type ink fountain according to claim 1, wherein said flow profiles are protrusions formed on said rear wall.

* * * * *